US006540273B2

(12) United States Patent
Brammall et al.

(10) Patent No.: US 6,540,273 B2
(45) Date of Patent: Apr. 1, 2003

(54) SECURITY SEAL AND LOCK WITH ENHANCED BORE SLEEVE

(75) Inventors: Terrence N. Brammall, Angola, IN (US); Jeffrey A. Brimmer, Angola, IN (US); Carlos Pinho, North Arlington, NJ (US); Richard Gnoinski, North Arlington, NJ (US); Craig B. Hamilton, Waterloo, IN (US); Richard Dreisbach, North Arlington, NJ (US)

(73) Assignee: Transguard Industries, Angola, IN (US)

( * ) Notice: Subject to any disclaimer, the term of this patent is extended or adjusted under 35 U.S.C. 154(b) by 38 days.

(21) Appl. No.: 09/753,850

(22) Filed: Jan. 3, 2001

(65) Prior Publication Data

US 2002/0089192 A1 Jul. 11, 2002

(51) Int. Cl.[7] ..... B65D 27/30

(52) U.S. Cl. ..... 292/315; 292/307 A; 292/307 B; 292/318; 292/321; 292/323; 292/324; 292/325; 292/326

(58) Field of Search ..... 292/315, 307 R, 292/314, 317, 319, 318, 321, 323, 324, 325, 326, 307 A, 307 B; 24/115 L, 136 A, 136 L; 188/65.1, 67

(56) References Cited

U.S. PATENT DOCUMENTS 3,994,521 A * 11/1976 Van Gompel ..... 24/136 A
4,075,742 A * 2/1978 Remark et al. ..... 24/453
4,534,192 A * 8/1985 Harshbarger et al. ..... 109/59 R
4,642,854 A * 2/1987 Kelly et al. ..... 24/129 R
4,681,356 A * 7/1987 Brammall ..... 24/115 G
4,846,011 A * 7/1989 Gaffney ..... 464/30
5,222,776 A 6/1993 Georgopoulos et al.
5,352,003 A * 10/1994 Bystry ..... 292/252
5,450,657 A * 9/1995 Georgopoulos et al. . 24/115 M
5,582,447 A 12/1996 Leon et al.
5,647,620 A * 7/1997 Kuenzel ..... 292/307 R
5,820,176 A 10/1998 Leon et al.
6,039,365 A * 3/2000 Rogatnev ..... 292/318
6,131,969 A * 10/2000 Natkins ..... 24/136 R
6,155,617 A * 12/2000 Kuenzel ..... 292/307 R

FOREIGN PATENT DOCUMENTS

GB 1432642 A * 4/1976 ..... F16G/11/02

* cited by examiner

*Primary Examiner*—J. J. Swann
*Assistant Examiner*—Thomas Ho
(74) *Attorney, Agent, or Firm*—Carella Byrne Bain Gilfillan Cecchi et al.; John G. Gilfillan, III.; William Squire

(57) ABSTRACT

One end of a stranded steel cable is attached to a cast zinc seal housing having a chamber in which a steel sleeve with a tapered bore is positioned. The sleeve in one embodiment is fixed to the housing in the chamber or may be displaceable and captured in the chamber in a further embodiment. A serpentine clip locking member captured in the housing chamber resiliently radially grips the a second end of the shackle inserted into the sleeve bore and wedges and locks to the cable and sleeve when the shackle is withdrawn. The sleeve precludes damage to the softer zinc housing by the locking member when the locking member is displaced in the housing chamber. Various embodiments are disclosed. In a further embodiment, the one end of the cable exits the housing in a plane different than where the second end enters the chamber to enhance ease of insertion of the second end into engagement with the locking member.

33 Claims, 7 Drawing Sheets

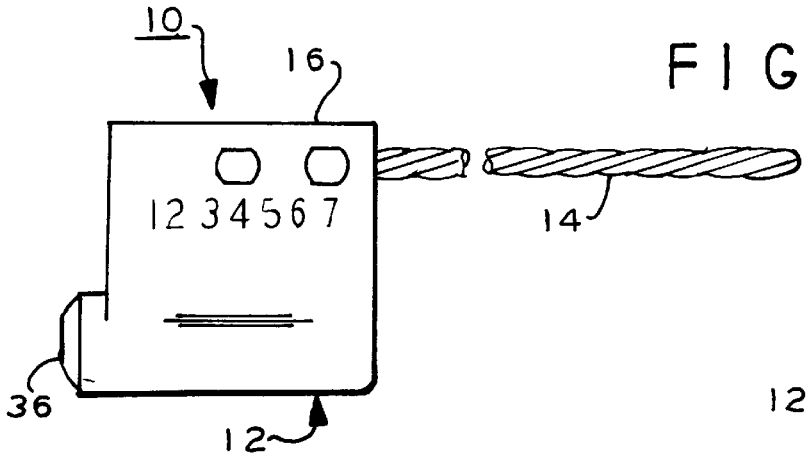
FIG. 1
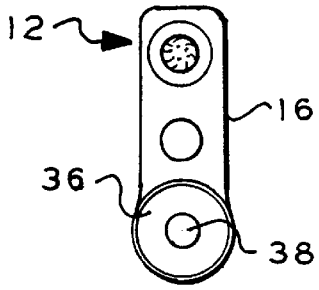
FIG. 2
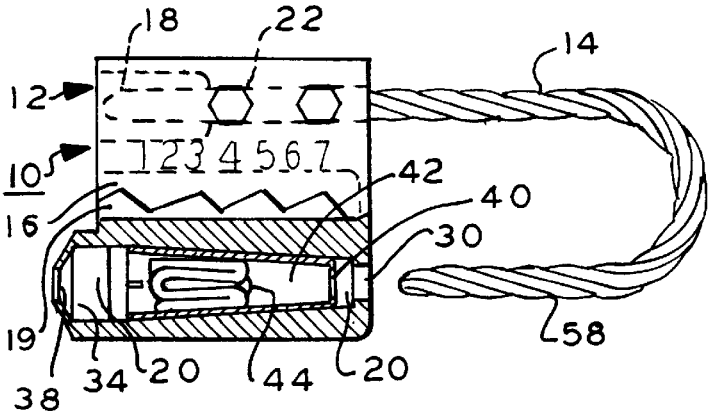
FIG. 4
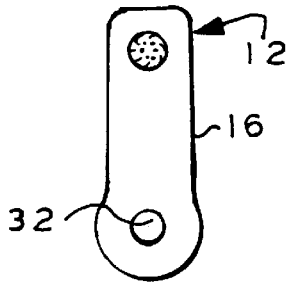
FIG. 3
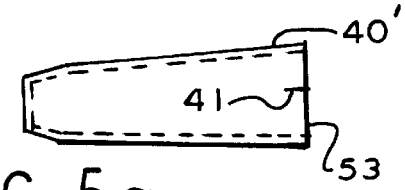
FIG. 5a
FIG. 5b
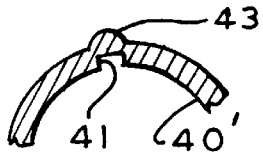
FIG. 5
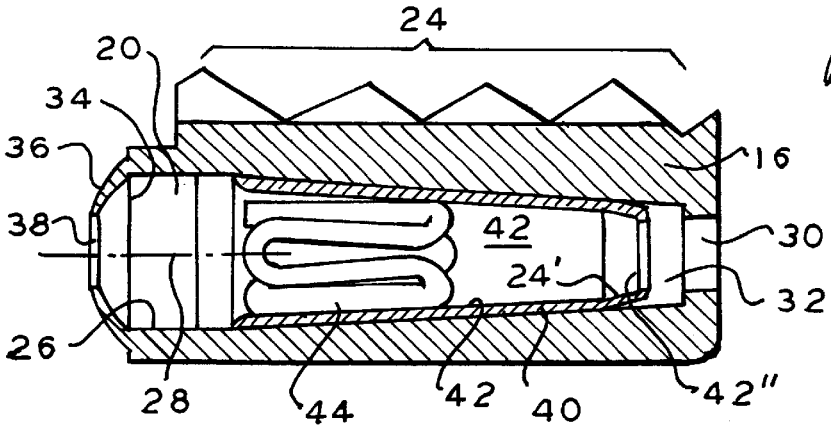

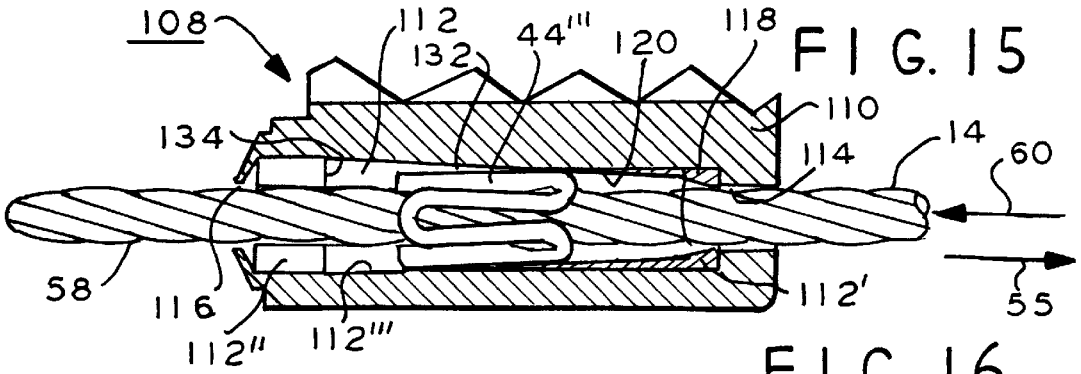
FIG. 15
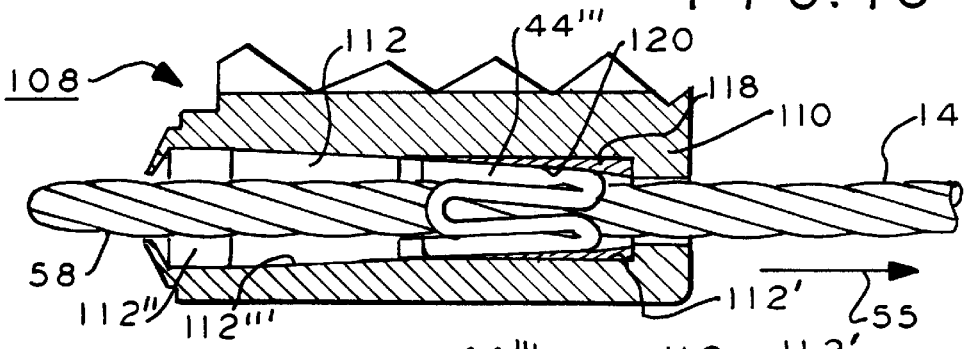
FIG. 16
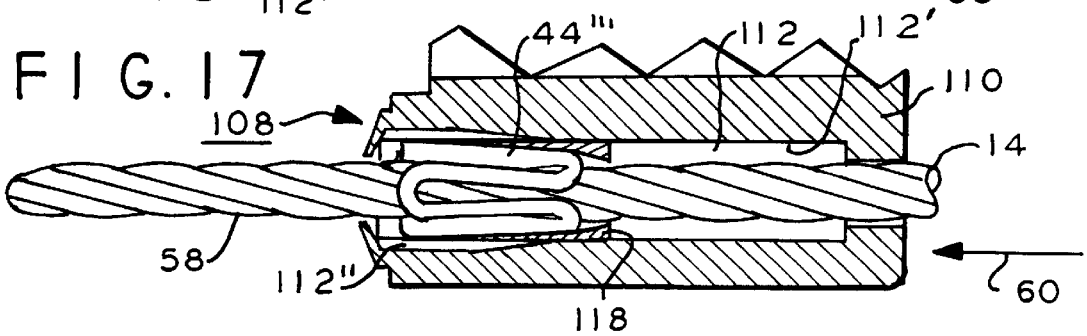
FIG. 17
FIG. 18
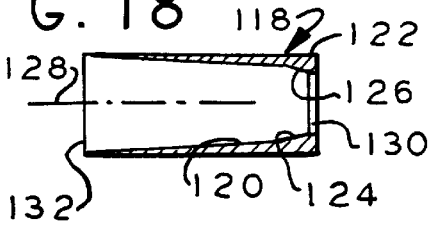
FIG. 18a
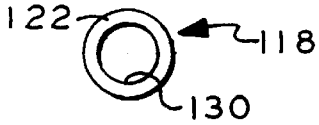
FIG. 19
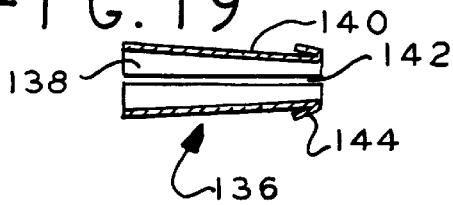
FIG. 20
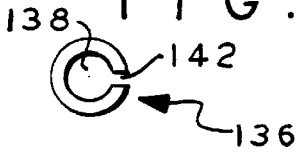
FIG. 21
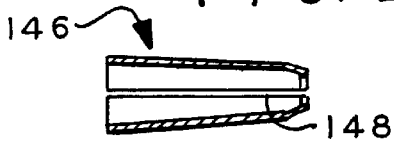

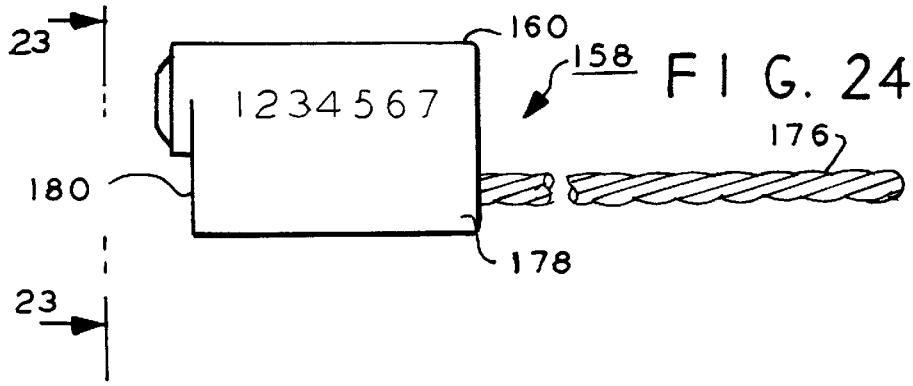
FIG. 24
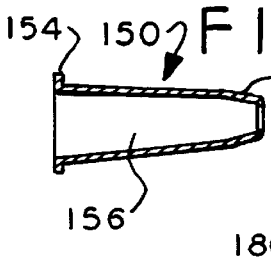
FIG. 22
FIG. 25
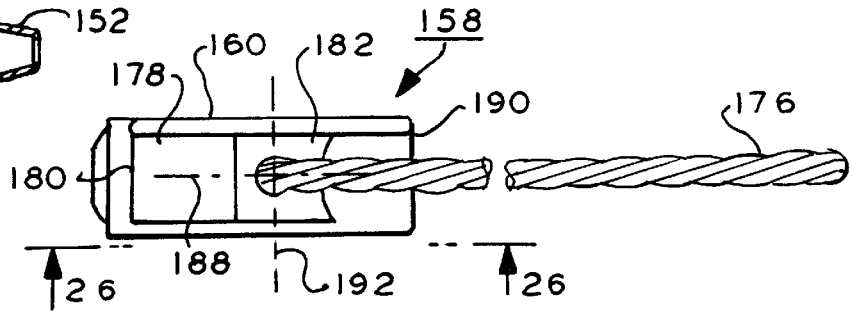
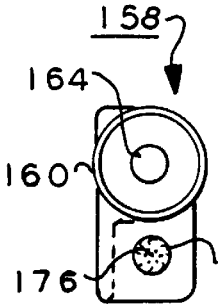
FIG. 23
FIG. 26
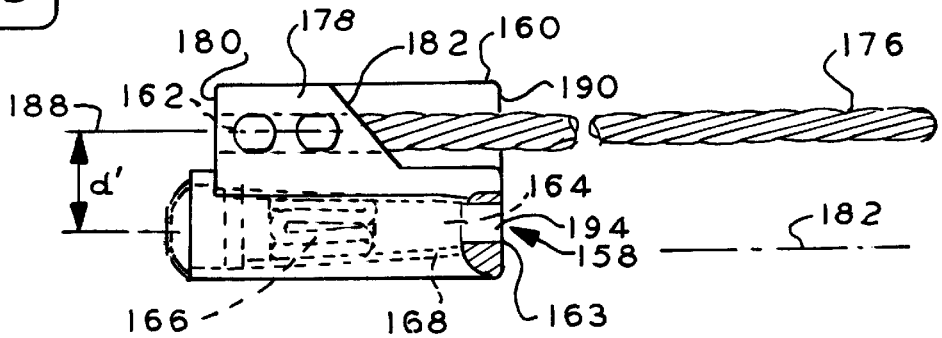
FIG. 27
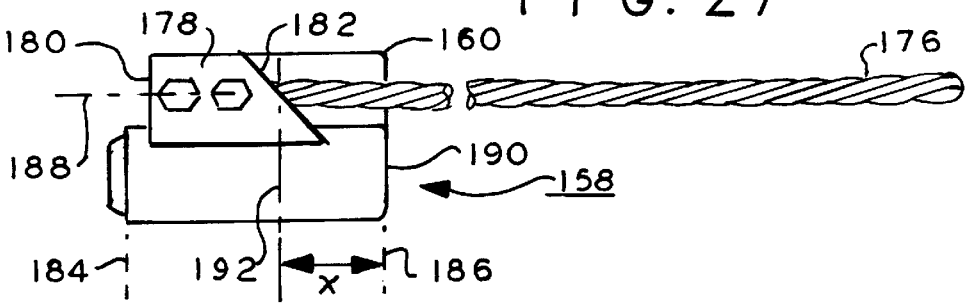

SECURITY SEAL AND LOCK WITH ENHANCED BORE SLEEVE

This invention relates to seals that comprise a body to which an end of a shackle, e.g., a solid or stranded steel cable, is attached, the free end being used to secure an article and the like. The free end is inserted into the seal for locking engagement with a locking collet in the seal, the free end for passing through the collet and seal and wedge locking to the collet and body in the withdrawal direction.

Of interest are commonly owned U.S. Pat. Nos. 5,582,447 ('447), 5,222,776 and 5,820,176, all relating to security seals and locks and which are incorporated, by reference herein in their entirety.

Each of the above patents generally disclose seals relating to the seal disclosed herein. In particular, the '447 patent is of particular interest. This patent discloses a serpentine clip which forms a locking collet, made of steel or other materials which is located in a tapered bore of a housing. One end of a stranded cable is secured and locked to the housing by a first clip in a first tapered bore of the housing or may be swaged to the housing in the housing first bore. The seal has a second bore which is tapered and in which a second clip collet is located. When a cable or wire is inserted into the second tapered bore and through the second collet, the collet resiliently grips the cable or wire and displaces with it as the cable is withdrawn. The collet and tapered.bore permit any length of cable or wire to be inserted therethrough in the insertion direction which is toward the larger end of the tapered bore. The larger bore end permits the collet to expand and let the cable or wire slip therethrough.

Any attempt to withdraw the cable or wire pulls the collet therewith wedging the collet against the narrow end of the tapered bore, locking the collet to the cable or wire and to the housing. This housing is disclosed as comprising hardened metal or plastic, but in current practice preferably comprises die cast zinc.

However, thermoplastic material or zinc are not generally as strong as hardened steel and may not survive the rigors of use, especially tampering attempts in which the cable or wire is repetitively pulled back and forth to displace the collet therewith and defeat the seal. This action may cause the reciprocating clip collet to damage the seal housing internally and diminish the integrity of the seal. Also, evidence of such tampering attempts are not readily apparent from external observation of the locked seal.

The other patents noted above disclose similar security seals employing balls as the locking elements instead of the locking clip collet of the '447 patent.

The present inventor recognizes a need for a seal such as disclosed in the '447 patent discussed above, but which preferably uses other materials such as zinc. However, since these other materials are not as resistant to damage as steel, use of such materials may not be as desirable for this type of seal.

A seal according to the present invention comprises a housing made of a first material and having a first chamber with opposing first and second ends, the housing having an opening in communication with the ambient atmosphere and the chamber at least the chamber first end. A sleeve is in the chamber and has a tapered bore in communication with the opening and made of a second material different than the first material, the bore tapering in a first direction from a large transverse dimension adjacent to the chamber second end to a relatively smaller transverse dimension adjacent to the first chamber first end. A shackle has a free end for insertion into the sleeve tapered bore through the opening in an insertion direction opposite the first direction. A locking member with a bore is located in the first chamber, the locking member for receiving and for gripping the shackle passing through the locking member bore, the locking member being free to displace with the shackle in the first chamber and tapered bore and being arranged to wedge against the sleeve and shackle in the tapered sleeve bore when the shackle is displaced in the first direction.

In one aspect, the second material is stronger than the first material.

In a further aspect, the second material is harder than the first material.

In a further aspect, the sleeve is dimensioned to be fixed in place in the housing first chamber. Preferably the sleeve is made of steel. In a further aspect, the sleeve has a length dimension and has a slit along the length dimension so that the sleeve is radially resilient.

In a further aspect, the housing first chamber is tapered, the sleeve having an external surface that is complementary to the housing first chamber taper.

Preferably the locking member is serpentine.

In a further aspect, the sleeve bore defines an axis, the locking member comprising a plurality of interconnected U-shaped loop members extending along the axis.

In a further aspect, the housing is at least one of plastic and zinc, the locking member is steel, and the sleeve is steel.

In a further aspect, the sleeve has a length between said chamber ends smaller than the chamber length between the chamber ends, the chamber having a transverse dimension relative to the sleeve outer dimension so that the sleeve can displace in the chamber with the locking member and shackle wedged to each other in response to displacement of the secured shackle in a direction opposite the first direction.

In a further aspect, the sleeve has an outer peripheral surface, and wherein the sleeve tends to displace in the chamber in response to insertion of the shackle therein, further including means for securing the sleeve in the chamber in fixed position to restrain the displacement of the sleeve in response to said insertion. In a further aspect, the means for securing the sleeve includes staking means for staking the sleeve to the housing.

In a further aspect, a seal according to an embodiment of the present invention comprises a housing having first and second ends lying in spaced parallel planes, the housing having a first chamber terminating at the second end at a first opening in communication with the ambient atmosphere and a second chamber terminating at a third housing end at a second opening in communication with the ambient atmosphere, the second opening being medial the spaced parallel planes. A shackle having a third end is secured to the housing in the second chamber and has a free end exiting the second chamber through the second opening, the free end for insertion into the housing first chamber through the first opening in an insertion direction. A locking member with a bore is located in the first chamber, the locking member for receiving and for gripping the shackle passing through the locking member bore, the locking member and chamber being arranged to wedge the locking member in the chamber when the shackle is displaced in a withdrawal direction opposite the insertion direction.

IN THE DRAWING:

FIG. 1 is a side elevation view of a seal according to an embodiment of the present invention;

FIG. 2 is an end view of the seal of FIG. 1;

FIG. 3 is an end view of the seal of FIGS. 1 and 2 taken at an end opposite the end of FIG. 2;

FIG. 4 is an elevation view partially in section of the seal of FIG. 1;

FIG. 5 is a side elevation sectional view of the sectional portion of the seal of FIG. 3 without the locking member in place;

FIG. 5*a* is a side elevation view of a second embodiment of a sleeve for use with the seal housing of FIG. 4;

FIG. 5*b* is a fragmented sectional end view of the sleeve of FIG. 5*a;*

Figure 7:
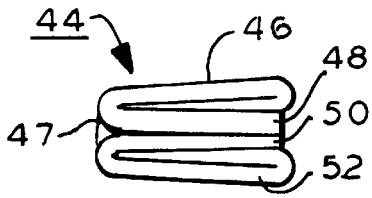
Figure 6A:
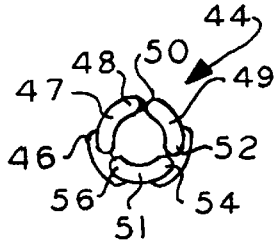
Figure 7A:
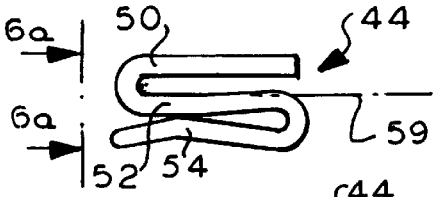
Figure 6B:
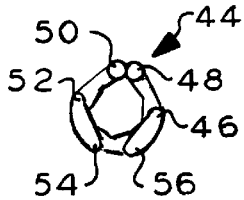

FIGS. 6*a* and 6*b* are respective opposing end elevation views of the locking member of FIG. 7*a;*

Figure 7B:
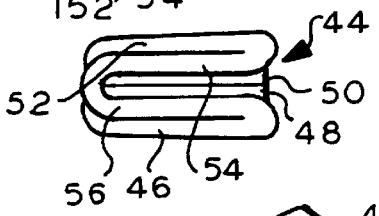
Figure 8:
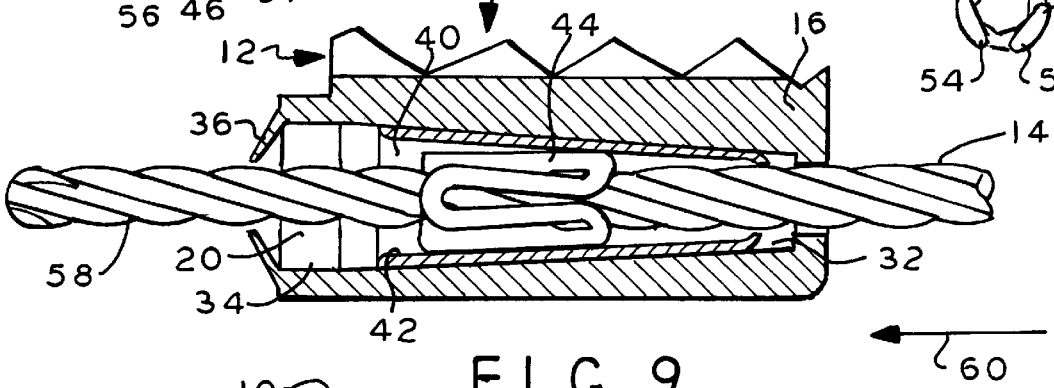
Figure 9:
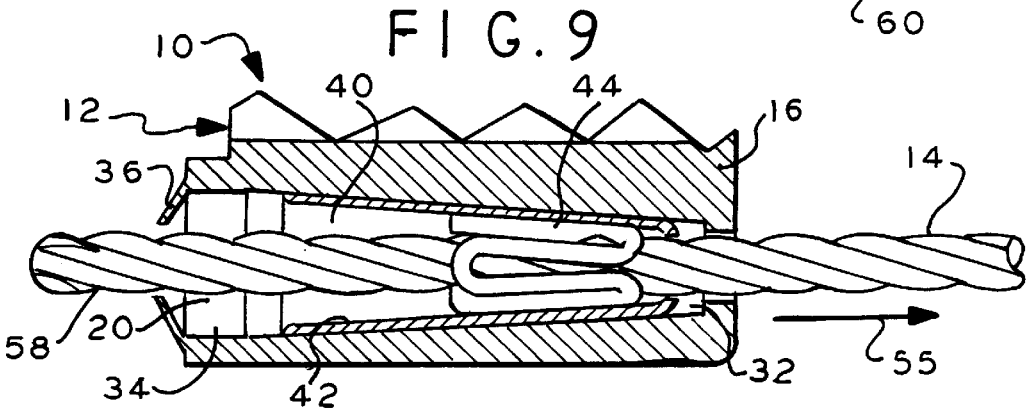
Figure 10:
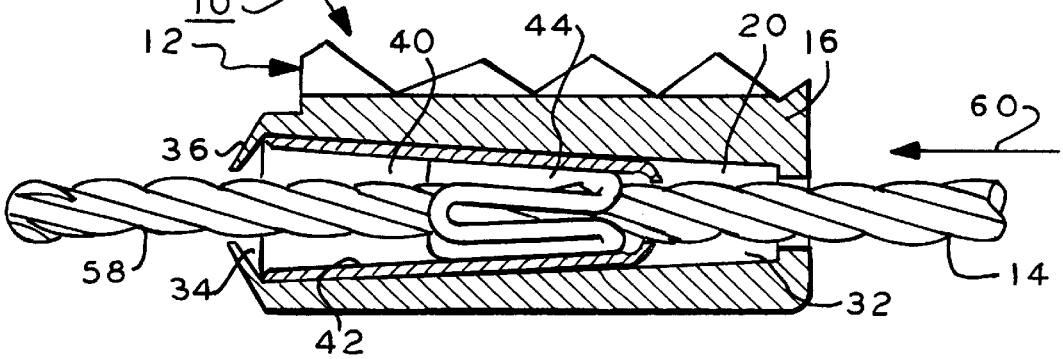
Figure 11:
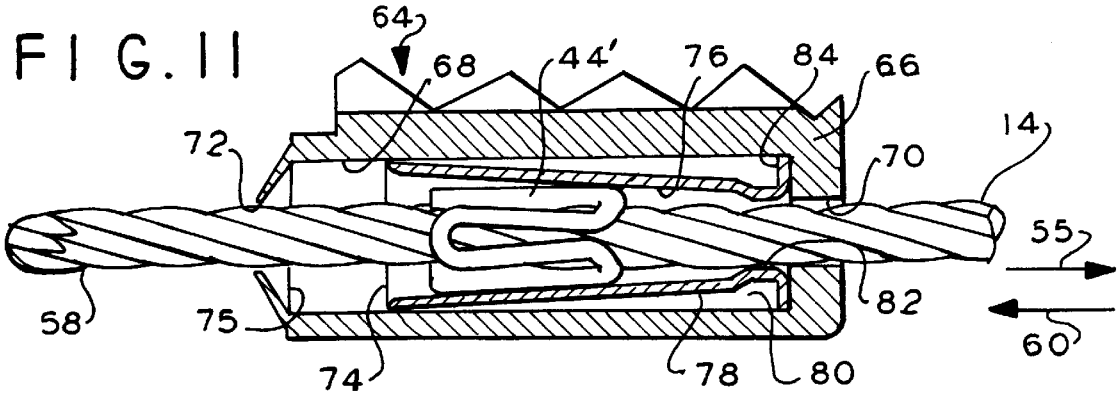
Figure 12:
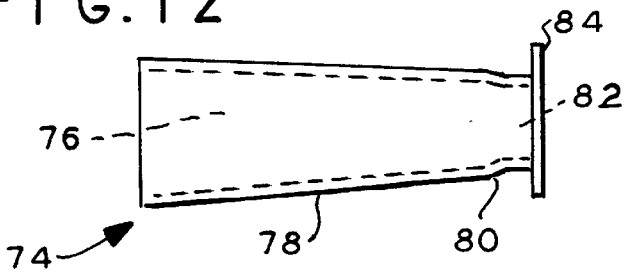
Figure 12A:
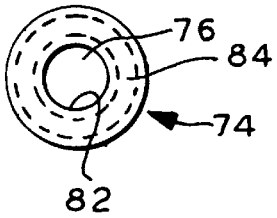
Figure 13:
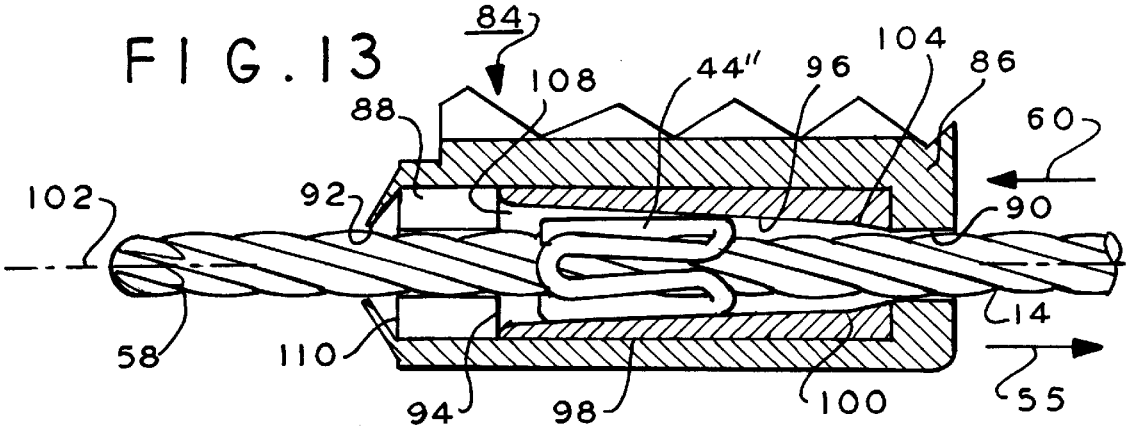
Figure 14:
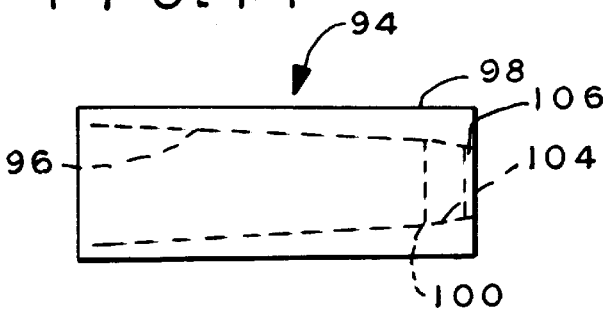
Figure 14A:
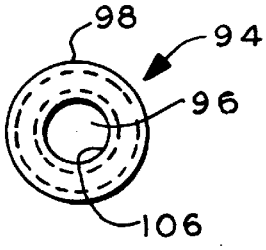
Figure 28:
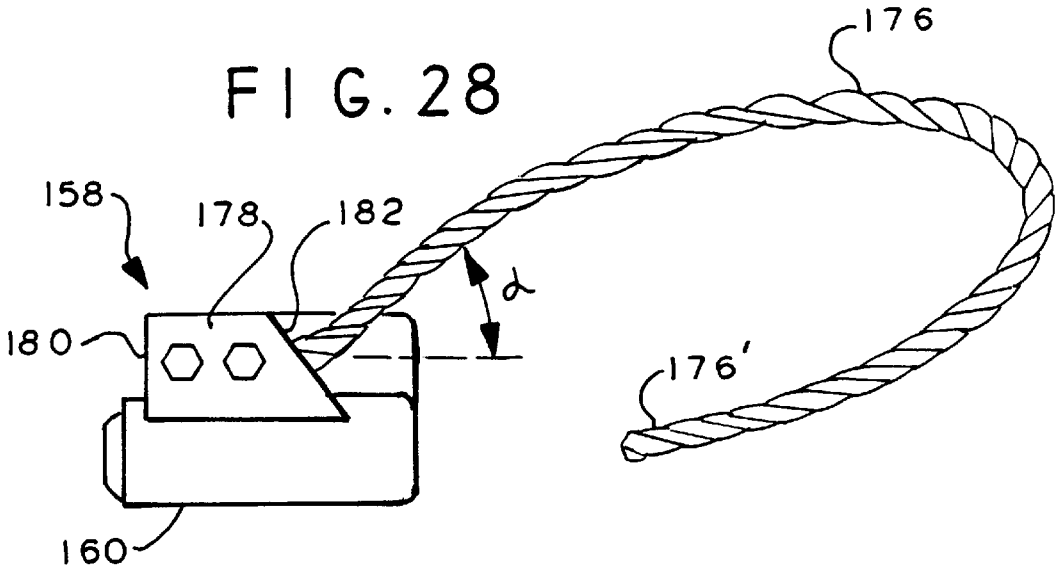
Figure 29:
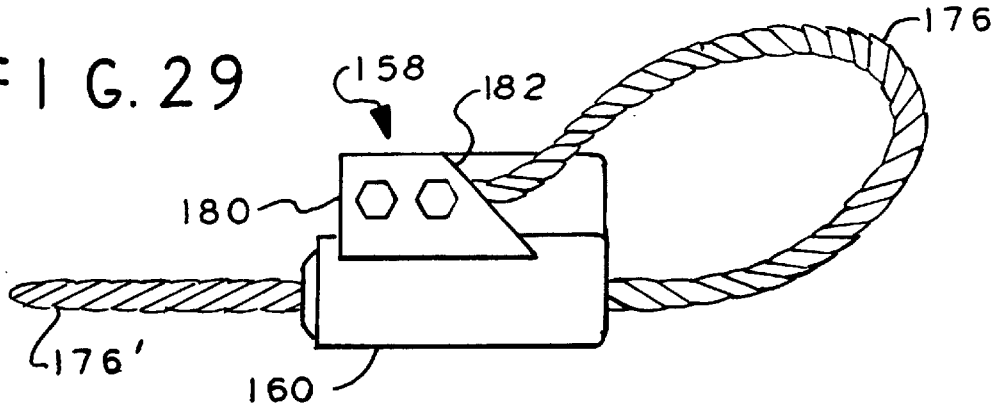
Figure 30:
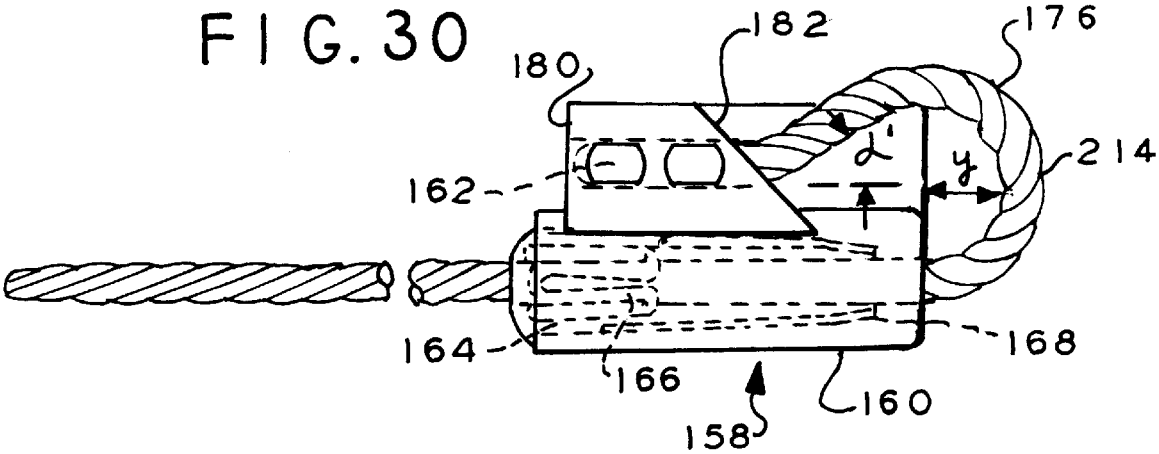
Figure 31:
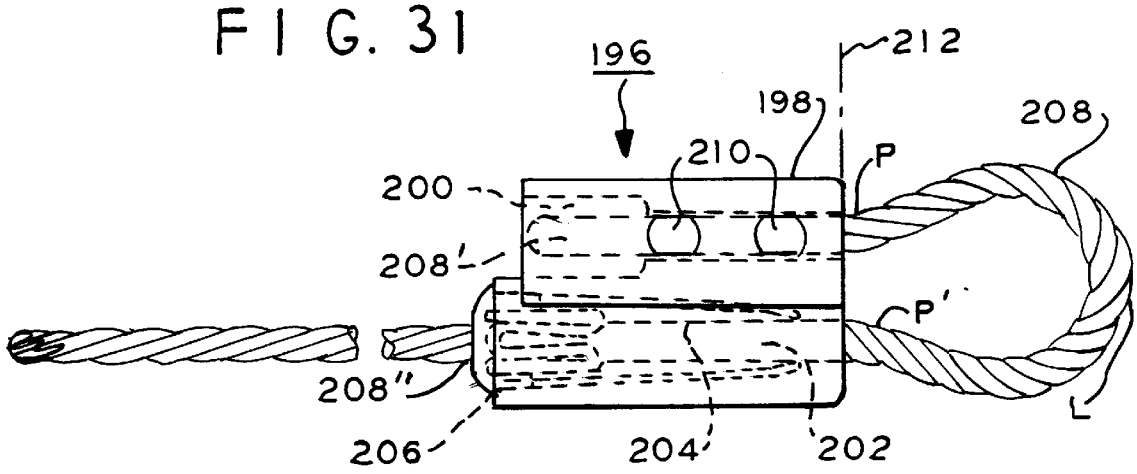
Figure 32:
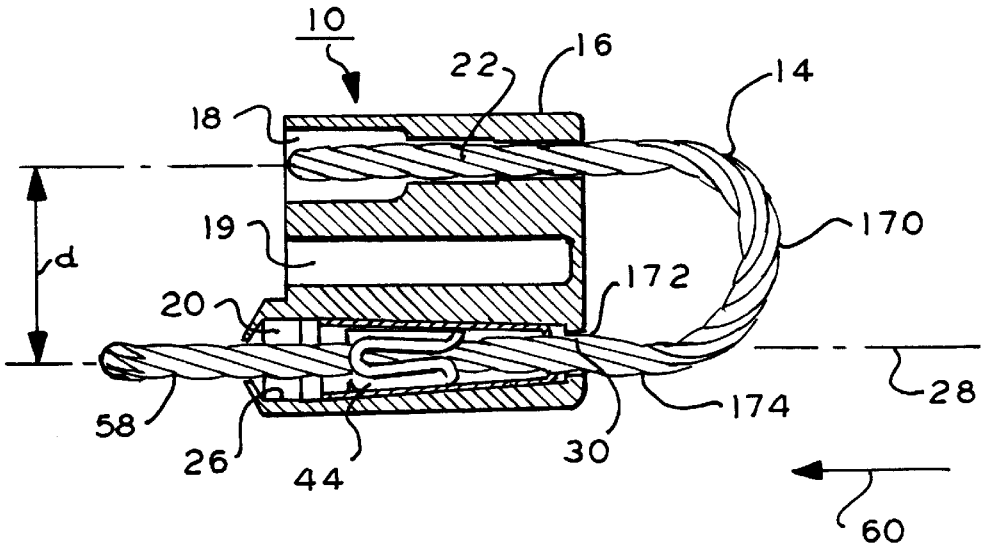

FIGS. 7, 7*a* and 7*b* are respective different side elevation views of the locking member of the embodiment of FIGS. 4 and 5;

FIGS. 8–10 are views similar to FIG. 4 showing various stages of assembly of the shackle to the seal;

FIG. 11 is an elevation fragmented view partially in section of a further embodiment of a sleeve, locking member and housing;

FIG. 12 is a side elevation view of the sleeve of the embodiment of FIG. 11;

FIG. 12*a* is an end elevation view of the sleeve of FIG. 12;

FIG. 13 is a view similar to that of FIG. 11 showing a further embodiment of a sleeve for use with a locking member and housing;

FIGS. 14 and 14*a* are respective side and end elevation views of the sleeve of FIG. 13;

FIGS. 15–17 are side elevation fragmented partially in section views of a sleeve, locking member and housing according to a further embodiment in various stages of assembly of the shackle to the seal;

FIGS. 18 and 18*a* are respective side elevation sectional and end elevation views of the sleeve of FIGS. 15–17;

FIGS. 19 and 20 are respective side elevation sectional and end elevation views of a sleeve according to a further embodiment;

FIG. 21 is a side elevation sectional view of a sleeve according to a further embodiment;

FIG. 22 is a side elevation sectional view of a sleeve according to a further embodiment;

FIG. 23 is an end elevation view of the seal of FIG. 24 taken along lines 23—23;

FIG. 24 is a side elevation view of a seal according to a further embodiment of the present invention;

FIG. 25 is a bottom plan view of the seal of FIG. 24;

FIGS. 26 and 27 are side elevation views of the seal of FIG. 25 taken long lines 26—26;

FIGS. 28, 29 and 30 illustrate various stages of assembly of the hackle;

FIG. 31 illustrates the problem with employing a housing configuration similar to that of the embodiment of FIG. 1 wherein the mass of the housing is reduced; and FIG. 32 is a sectional elevation view of the embodiment of FIG. 1 in the locked stage.

In FIG. 1, seal and lock assembly 10 comprises a seal and lock 12 to which is permanently secured a shackle 14 which preferably comprises stranded steel cable and may be other materials as desired for a given implementation, e.g., plastic or other metals, solid or stranded, including wires or filaments. The lock 12 includes a housing 16 which may be constructed as described and shown in the aforementioned patents in the introductory portion, and preferably as disclosed in the '447 patent. However, the preferred embodiment of the housing is as disclosed hereinafter. Modifications of the housings in the aforemtentioned patents should be made to meet the requirements of the present invention as described below.

In FIG. 4, the housing 16, which is preferably cast zinc, has two chambers 18 and 20. The housing also has a bore 19 which serves to reduce the amount of material used to form the housing 16 to reduce cost. One end 22 of the cable shackle 14 is secured to the housing 16 in the chamber 18 as by swaging or staking for example. In the alternative the end 22 may be locked to the chamber 18 in a manner similar to that disclosed in the '447 patent using a locking collet member as will be described below.

The second chamber 20, in the embodiment of FIG. 5, is partially tapered, and preferably frusto-conical, in portion 24 and circular cylindrical in portion 26. The length of chamber 20 portion 24 may be about 88% of the axial length of the chamber 20. The circular cylindrical portion 26 has a diameter about the same as the larger diameter end of portion 24. Portion 26 may also taper to an even larger diameter in the alternative, if desired.

A reduced diameter through hole 30 is at the smaller diameter end of the chamber 20, and may be circular cylindrical. Hole 30 is sufficiently large to receive the shackle 14 therethrough. Hole 30 is smaller in diameter than the smallest diameter of the chamber 20 at the hole 30 end 32 of the chamber 20. End 34 of the chamber 20 opposite end 32 is partially enclosed by swaged over thin wall portion 36 of the housing 16. A second reduced diameter hole 38 of about the same diameter as hole 30 is formed in portion 36. Holes 30 and 38 are aligned concentrically on axis 28.

Located in the chamber 20 is a preferably steel sleeve 40. The sleeve 40 extends for an axial extent smaller than portion 24, e.g., about 86% of the length of portion 24. Sleeve 40 is thin walled and has an internal tapered bore 42 and an external tapered outer surface. Preferably the inner and outer tapers are frusto-conical. The sleeve 40 bore 42 and outer surface has two portions 42' and 42". Portion 42' extends for a major length of the sleeve, e.g., about 90%. The external peripheral surface is complementary to and closely received in the chamber 20 tapered portion 24. Bore portion 42' has an external peripheral surface that is has a more gradual taper than portion 42". However, the sleeve 40 does not wedge in the chamber 20 smaller diameter end or portion 24 and can be displaced axially therefrom toward end 34 of the housing chamber 20. The sleeve internal bore 42 has a diameter at end 32 that is about the same as the diameter of the hole 30.

In FIG. 5*b*, a portion of sleeve 40' is shown wherein the sleeve 40' in an alternative embodiment, has a plurality of annularly spaced radially outwardly extending notches 41. The notches distort the material forming radially outwardly extending projections 43. The notches 41 and projections 43 are formed at the large diameter end 53, FIG. 5*a*, of the sleeve while the sleeve is in the bore 20 of the housing 16, FIG. 4. These projections 43 are in the form of rounded raised bumps. The projections 43 lightly stake the sleeve 40' to the housing 16 at the chamber 20 larger end to secure the sleeve 40' to the housing 16 in fixed position in the preferred embodiment. This position is the position of the sleeve 40 in FIG. 5.

A serpentine shaped collet clip locking member 44 is in the chamber 20 and in the bore 42 of the sleeve 40. The member 44 is shown in more detail in FIGS. 6*a*, 6*b*, 7, 7*a* and 7*b*. The member 44 comprise a plurality of legs 46, 48, 50, 52, 54 and 56 which extend in a generally similar direction relative to a central axis 59. Legs 54 and 56 are inclined toward axis 59 and toward legs 52 and 46, respectively. The adjacent legs are joined at their ends by arcuate end portions 47, 49 an 51 and so on. Legs 46 and 48 and portion 47 form a U-shaped loop. Similarly, legs 50 and 52 and end portion 49 form a U-shaped loop as does legs 54 and 56 and end portion 51 and so on. Legs 48 and 50 terminate adjacent to each other and are also approximately parallel to each other. The legs and end portions extend about axis 59 and generally along this axis, and in practice may be inclined relative to each other and/or to the axis. The legs and end portions in end view, FIGS. 6*a* and 6*b*, form a ring. Various embodiments of the member 44 are described in greater detail in the aforementioned '447 patent incorporated by reference herein. Reference is made to that patent for variations in the member 44 construction and materials. In this embodiment, the member 44 is steel solid wire. The member 44 resembles a paper clip somewhat, but in ring shape with multiple loops that extend about the axis 59. The legs of member 44 are radially resilient and resiliently compressively engage the shackle 14, FIG. 4, gripping the shackle when it engages and is received in the bore of the member 44.

In FIG. 4, the locking member 44 is in the sleeve, both the locking member 44 and the sleeve 40 are in the chamber 20. The locking member 44 has an outer diameter smaller than the inner diameter of the chamber 20 portion 26, FIG. 5. The member 44 can axially displace partially into the chamber 20 portion 26 externally the sleeve 40 along the axis 28 to the left in the figure (as illustrated in FIG. 15 in another embodiment).

In operation, in FIG. 8, the free end 58 of the shackle 14 is passed through the chamber 20 and through the sleeve bore 42 and exits the housing 16 hole 38 (FIG. 5). The shackle 14 also passes through the locking member 44 bore. The bore of the member 44 is sufficiently smaller than the outer diameter of the shackle 14 so as to resilient grip the shackle. This action is described more fully in the '447 patent. The friction grip of the member 44 to the shackle causes the member. 44 to displace toward end 34 of the chamber 20, FIG. 8. The swaged over housing portion 36 captures the locking member 44 in the chamber 20 as seen in FIG. 8. A portion of the member 44 is also in the sleeve bore portion 24, FIGS. 5 and 8. The sleeve 40 bore in portion 24 at its larger diameter nearest end 34 of the chamber 20 is larger than the member 44 outer diameter. The sleeve smaller diameter end of portion 24 and portions 24' are smaller than the member 44 outer diameter.

During insertion of the shackle 14 in the insertion direction 60, FIG. 8, the shackle pulls the locking member 44 also in direction 60. In some implementations, the locking member 44 also may grip the sleeve 40 somewhat and pull the sleeve 40 therewith as well. This is not desirable at the sleeve restricts the radial opening of the member 44 upon pulling of the shackle therethrough. This may make insertion of the cable difficult. Therefore, it is preferable that the sleeve 40 remain in the rightmost position of FIG. 4 during insertion of the shackle.

This retention of the sleeve in the position of FIG. 4 during insertion is provided by notches 41 and burrs 43 or similar projections. The notches 41 stake the sleeve slightly to the housing in chamber 20 preventing the sleeve 40 from displacing to the left in the figure during insertion of the shackle end 58 in direction 60. With the sleeve so staked, the insertion of the shackle through the member 44 pulls the member 44 to the left in the figure toward the larger diameter portion of the chamber 20 and partially clear of the sleeve. The member 44 in this position, can freely expand radially to permit the shackle to be pulled easily through the member 44, although the member 44 exerts some radial resilient load on the shackle at this time. The staking may be optional depending upon the relative dimensions of the various components in certain implementations.

Once the shackle is inserted into the chamber 20 and member 44 and passes through the housing bore 38, the shackle can no longer be withdrawn in direction 55, FIG. 9. When the shackle 14 is pulled in the withdrawal direction 55, FIG. 9, the member 44 is pulled with the shackle in this direction. This action wedges the clip member 44 against the shackle 14 and against the sleeve 44 inner surface. The shackle is locked in place and can not be further withdrawn.

When the shackle 14 is displaced in the insertion direction 60, FIG. 10, the locking member 44 being wedged attached to the shackle and to the sleeve 40, may cause all three elements to displace in the insertion direction 60. This is especially if the sleeve is not staked in place. If the sleeve is staked sufficiently in place, then the shackle, member 44 and shackle can not displace in direction 60.

Without staking of the sleeve, the sleeve is free to displace in direction 60. This is because the chamber 20 portion 24 is dimensioned to permit this relative motion and since the sleeve is not dimensioned to wedge clamp to the housing in chamber 20. The cable shackle is now free to displace in both directions 58, FIG. 9, and 60, FIG. 10, a small distance.

Should a tamperer attempt to withdraw the shackle in direction 55, FIG. 9, this will cause the sleeve to catch somewhat against the housing in the bore and provide resistance to displacement in the direction 60. Any attempt to displace the shackle later can detect this resistance and provide evidence of an attempt at tampering and thus result in a closer examination of the seal to determine if the integrity of the seal was compromised. However, it is preferred that the sleeve 40 be staked to the housing rather than float in the housing chamber. This provides ease of insertion of the cable shackle in this embodiment even though tamper evidence is reduced accordingly. The tamper evidence is provided by the wedged locked engagement of the cable, collet locking member 44 and the sleeve to the housing when the sleeve is permitted to otherwise float in the housing chamber.

The preferably steel sleeve does not damage the housing 16 in the chamber 20 in those cases where the sleeve is not fixed in position, i.e., by staking. This is because the exterior surface of the sleeve is smooth and does not injure the interior chamber surface should the sleeve be displaced in the chamber. Thus the locking member 44 and sleeve in certain embodiments without staking of the sleeve to the housing can float in the chamber 20. Such floating is not desirable in the present embodiment in that the locking member may become stuck in the sleeve in a relative position where the locking member can not readily radially displace outwardly during insertion of the cable and thus interferes with the insertion of the shackle making this more difficult.

The seal construction described advantageously permits a relatively soft material housing such as zinc to be used than otherwise, possible without the sleeve 40. Thus low cost plastic and zinc housings can be used while providing enhanced security with this type of locking arrangement. The sleeve 40 enhances the utility of the assembly 10 without a detrimental reduction in security.

However, the problem of the floating sleeve can also be avoided without staking the sleeve by relative dimensioning of the housing chamber, sleeve and locking member in further embodiments. As long as the locking member can radially expand during insertion of the cable, then it does not matter if the sleeve is fixed in place or displaces. If the sleeve does displace, the end edge of the sleeve will stop when it reaches end 34 of the chamber 20, FIG. 4. At this point, the locking member and cable can be further displaced in the insertion-direction 60, FIG. 8. They are displaced to a point where the locking member has room to expand within the sleeve whose bore is sufficiently large to permit such expansion at this location in the sleeve. Such radial expansion of the locking member permits the cable to be further displaced relative to.the locking member. In this case, the sleeve when displaced in the withdrawal direction 55, FIG. 9, may become slightly wedged to the chamber. This slight wedging shows withdrawal of the shackle and an attempt at tampering can be made by feel of a person tugging on the shackle cable in the insertion direction 55.

A zinc body forming the housing 16 is ductile. This material does not permit ease of sliding motion of the locking collet member 40 in the housing chamber. Therefore, the steel sleeve permits the locking member 40 to slide therein more easily than in a zinc housing chamber with direct contact between the two materials. The softer ductile zinc material may also permit the displacing locking member to dig into the housing in the chamber and build up material in front of the locking member preventing it.from displacing during insertion of the shackle cable.

In FIG. 11 assembly 64 comprises housing. 66 having a chamber 68. The housing has two openings 70 and 72 in communication with the chamber 68. Chamber 68 is circular cylindrical. A preferably steel sleeve 74 is in the chamber 68. The sleeve may be press fit in place, staked in place or may float axially in directions 58 and 60 in chamber 68 according to a given implementation. Preferably the sleeve is in fixed position.

The sleeve 74, FIGS. 11, 12 and 12*a*, has a tapered bore 76 and a like tapered outer surface 78. The tapers may be frusto-conical for at least a portion of the bore 76 up to point 80. The tapered portion of the bore 76 terminates at point 80 of bore 76. At point 80, the bore 76 terminates in a smaller diameter restricted bore 82 that is circular cylindrical. A radially outwardly extending flange 84 is at the smaller bore 82 end of the sleeve. The flange radially supports the sleeve 74 in the cylindrical housing chamber 68. The sleeve if not staked or press fit in place, may be free to displace axially in the chamber 68. The sleeve 74 at end 75 of the chamber 68 has its greatest diameter and is spaced from end 75. This spacing provides room for a portion of the locking member 44'. This position of the locking member permits the locking member to radially expand outwardly when the cable 14 is inserted in the insertion direction 60 permitting the cable 14 to slide within the bore of the locking member 44' and out of the housing chamber through opening 72 to the position shown. The locking member 44' and cable 14 are wedge secured to the sleeve 74 by pulling of the cable in the withdrawal direction 55. Once wedged together they no longer can be separated by manipulation of the cable.

In FIG. 13, assembly 84 comprises housing 86 having a chamber 88. The housing has two opposing end openings 90 and 92 in communication with the chamber 88. Chamber 88 is circular cylindrical. A preferably steel sleeve 118 is in the chamber 88. The sleeve 94, FIGS. 13, 14 and 14*a*, has a tapered bore 96 and a circular cylindrical outer surface 98. The outer surface 98 is complementary to the chamber 88 inner cylindrical surface. The sleeve 94 may be press fit in place, staked in place in the chamber 88 or it may float depending upon a given implementation and dimensions of the elements. The sleeve bore 96 taper is preferably frusto-conical for at least a portion of the bore 96 up to point 100. The frusto-conical portion of the bore 76 terminates at point 100 of bore 96. At point 100, the bore 96 tapers at a more inclined frusto-conical taper 104 relative to the axis 102. The bore 96 terminates in a smaller diameter restricted bore 106 that is circular cylindrical. The sleeve 94 bore 96 has it widest diameter 108 spaced from end 110 of the cylindrical portion of the housing 86 chamber 88. This spacing permits a portion of the locking member 44" to enter this region and expand to permit the cable 14 to be inserted easily through the bore of the locking member 44", the sleeve 94 being fixed in place in this embodiment. The locking member and cable are secured wedged in place to the sleeve 94 by pulling the cable in the withdrawal direction 55 and can not be separated by manipulation of the shackle cable.

FIGS. 15–18*a* illustrate a further embodiment in which the sleeve 118 axially floats in the housing chamber 112. In FIG. 15, assembly 108 comprises housing 110 having a chamber 112. The housing 110 has two opposing end openings 114 and 116 in communication with the chamber 112. Chamber 112 has a first circular cylindrical portion 112', FIG. 17, a second larger diameter circular cylindrical portion 112" and a third tapered preferably frusto-conical portion 112'", FIGS. 15 and 16. The cylindrical portion 112' is the smallest diameter and portion 112" is the largest diameter.

A preferably steel sleeve 118 is in the chamber 112. The sleeve 118, FIGS. 18 and 18*a*, has a tapered bore 120 and a circular cylindrical outer surface 122. The outer surface 122 is complementary to the chamber 112 inner cylindrical surface in portion 112', but is free to axially displace in and out of portion 112'. The sleeve 118 floats axially in directions 55 and 60, the respective withdrawal and insertion directions, in the chamber 112 in all of the portions 112', 112" and 112'". The sleeve bore 120 taper is preferably frusto-conical for at least a portion of the bore 120 up to point 124. At point 124, the bore 120 tapers at a more inclined frusto-conical taper 126 relative to the axis 128. The bore 120 terminates in a smaller diameter restricted bore 130 that is circular cylindrical.

The sleeve 118, FIG. 15, at the time of insertion of the cable 14, is located entirely within the chamber 112 cylindrical portion 112'. Thus the sleeve 118 has it widest diameter 132 end spaced from the junction 134 between the chamber 112 cylindrical portion 112" and the tapered portion 112'". The locking member 44'" is partially in the bore 120 of the sleeve 118 and almost entirely in the tapered chamber portion 112'". As the cable 14 is inserted in direction 60, it pulls the locking member 44'" to the left in the figure into the housing chamber portion 112". This is the largest diameter of the chamber 112 and permits the locking member 44'" to readily radially expand as the cable 14 is further inserted in direction 60. The cable 14 thus passes easily through the-.bore of the locking member 44".

When the cable is pulled in the withdrawal direction 55, FIG. 16, the locking member 44'" is pulled with the cable 14 due to its radially resilient gripping of the cable. The locking member and cable are pulled in the direction 55 to the position shown in FIG. 16 wherein the locking member 44'" is secured wedged in place to the sleeve 94 and cable 14. With the cable, sleeve and locking member so wedged, displacement of the cable 14 in the insertion direction 60 is possible at which time the locking member and the wedged sleeve 118 displace in unison to the left in the figure to the position shown to the left most end of the chamber portion 112". The shackle cable 14 can not be removed from the housing 110.

In FIGS. 19 and 20 a further embodiment of a sleeve is shown. Sleeve 136 is of uniform thickness sheet metal, e.g., steel, that is formed with a frusto-conical bore 138 and exterior surface 140. The sleeve 136 is C-shaped and has a slit 142 for its full axial length. The small diameter end of the sleeve is rolled over at portion 144 to form a double thickness at this portion. The portion 144 supports the sleeve 136 in the mating housing bore which may be of complementary diametrical dimensions to closely receive the sleeve 136. The bore 138 is uniformly tapered throughout its length. This sleeve is resilient radially and may also wedge in place in the housing chamber when forced into a narrowed chamber end (not shown) in the withdrawal direction 55, FIG. 15, for example.

FIG. 21 illustrates a still further embodiment of a sleeve which may be used, in the alternative to the sleeves described above herein. In FIG. 21, sleeve 146 is sheet metal, e.g., steel, and is formed with a tapered bore and tapered external surface. It is similar to the sleeve 40, FIG. 5, except that a slit 148 is formed in the sleeve similar to slit 142, FIG. 19, in sleeve 136. The slit 148 also causes the sleeve 146 to be radially resilient.

In FIG. 22, a further embodiment of a sleeve includes a sleeve 150 having a body 152 with a tapered bore and tapered external surface. The sleeve 150 is preferably made of sheet metal. An annular flange 154 is at the bore 156 larger diameter end. The sleeve 150 mates in a housing chamber (not shown) with complementary surface features.

In FIG. 32, the seal 10 of FIG. 1 may exhibit several problems. First, the seal is relatively large and uses relatively a considerable amount of material, preferably zinc, which is costly. A second problem is in tightening the shackle 14 to the locked position shown. It is desirable to make the loop 170 as small as possible. In this example, the shackle 14 is stranded steel cable about 1/16 to 3/16 inch (1.6 mm to about 4.8 mm) in diameter. The center-to-center spacing d of the chambers 18 and 20 is about one inch (2.5 cm). The hole 30 has a relatively sharp comer 172 where the shackle 14 enters during insertion.

The spacing d limits the size of the loop 170. The shackle 14 cable has to bend into the loop 170 in order for the end 58 to be pulled tightly through the housing chamber 20. As the shackle end 58 is pulled or pushed through the chamber 20 and through the locking member 44, the bend in the shackle engages the sharp comer 172 of the housing. This comer must be sharp because if chamfered or rounded, space will be provided between the shackle and the housing which will permit tampering tools to be forced into the chamber 20 in an attempt to unlock the locking member. This chamfering or rounding the comer 172 is therefore not acceptable.

Due to the bend in the shackle in the loop 170, the portion 174 of the shackle at the entrance hole 30 tends to be inclined or bowed relative to the axis 28 of the chamber 20. This inclination of the shackle causes the shackle portion 174 to dig into the corner 172 of the hole 30 making insertion of the cable difficult. The tighter and smaller the loop 170, the greater this angle of insertion of the cable and the more difficult to insert the cable in direction 60. Thus it has been determined that the one inch spacing d for the size cable being used as noted above is about the minimum possible spacing in order for the shackle to be inserted with a reasonable force. This minimum spacing thus requires excessive amount of material in the housing 16. It is desirable to further reduce this spacing and the size of the housing without further increasing the insertion load on the shackle. This insertion load is due to dragging bent portion 174 over the comer 172 as the loop 170 is reduced in diameter. Should the spacing d be reduced in half to about 3/16 inch (12.7 mm) to reduce the amount of housing material used, it becomes very difficult to insert and tighten the shackle 14 loop 170 to a desired diameter.

In FIGS. 23–27, seal 158 solves the above described problem. The seal 158 comprises a housing 160 having chambers 162 and 164, locking member 166 and a sleeve 168 located in the housing chamber 166. The locking member 166 is serpentine as described above in connection with the FIG. 5 embodiment. The chamber 166 and sleeve 168 are also as described above in connection with the FIG. 5 embodiment by way of example and may be identical to such elements.

The housing 160 in which chamber 162 is located has a body 178. The body 178 has opposing end walls 180 and 182, FIG. 26. The wall 182 is preferably inclined about 45° to axis 182 of the chamber 164, but may be at other angles. The housing 160 ends lie in and define two parallel planes 184 and 186, FIG. 27. The wall 182, FIGS. 26 and 27, along the center axis 188 of the chamber 162 at plane 192, where the chamber exits the wall 182, is medially these two planes and lies in a plane that intersects the chamber 164. The wall 182 is spaced distance x from the end 190 at plane 186, FIG. 27. Distance x is important as it has been discovered that this spacing permits a larger loop of the shackle for a given spacing d' between the chamber 162 axis 188 and the chamber 164 axis 182. This larger loop of the shackle thus reduces the drag and digging action in the corner 163 of the chamber 164 shackle insertion hole 194, FIG. 26.

In FIG. 31, seal 196 has a housing 198 having chambers 200 and 202. The chambers are spaced apart a distance of about ½ inch for a cable of about 1/16 to 3/16 inch diameter instead of the on inch spacing of the embodiment of FIG. 4, all other parameters and elements being the same. Sleeve 204 is in chamber 202 and locking member 204 locks to the sleeve 204. Shackle 208 end 208' is staked to housing 198 at stakes 210. Shackle end 208" is locked to locking member 204 by locking member 206. Shackle 208 portion p' exits the housing 198 in the same plane 212 as the shackle end 208" portion p' enters the housing 198.

In comparison to the improved embodiment of FIG. 30, the loop L in FIG. 31 is larger and this loop L is at about its smallest size. The portions p and p' are inclined at the ingress to the housing 198. The portion p' inclination causes this portion to dig into the housing comer where it enters the housing chamber egress hole making further insertion of the cable difficult. It is so difficult to insert the cable to its final reduced loop L size that this size housing is impractical commercially. Therefore, it is impractical to reduce the housing 198 size to that of FIG. 31 as compared to that of FIG. 32 where the portions p and p' enter and exit the housing in the same plane 212.

In contrast, in FIGS. 28–30, the shackle 176 can be bent at a relatively larger angle ∀ at the housing 178 wall 182 as the shackle end 176' is pulled through the locking chamber 164. In FIG. 30, the angle ∀' permits a loop 214 to exhibit a smaller loop size y than otherwise possible for a housing reduced in dimension between the axes of the staking chamber and the locking chamber.

In the seal 158 of FIGS. 25–27, the shackle at its staked chamber egress and locking chamber ingress are not coplanar and the two locations are spaced from each other a distance x, FIG. 27. This distance x is sufficiently great to permit significant reduction in housing size and material as well as reducing the insertion force of the shackle. For example, in the FIG. 31 embodiment, the insertion force of the shackle may be about 10–12 lb. (4.6–5.6 kilogram) as compared to the FIG. 30 embodiment, where the insertion force may be about half, e.g., 6 lb (2.8 kilogram) for a given set of materials and dimensions of the housing, cable, locking chamber, locking member and sleeve. There is a noticeable improved reduction in insertion load in the FIG. 30 embodiment in the presence of a reduced spacing d', FIG. 26, over that of the FIG. 32 embodiment.

It will occur to one of ordinary skill in this art that various modifications may be made to the disclosed embodiments without departing from the spirit and scope of the invention. The disclosed embodiments are for illustration and not limitation. The invention is defined by the appended claims. For example, the axis of the staking chamber 162, FIG. 26, need not be parallel to the locking chamber and may be inclined toward the top of the drawing sheet and to the right of the figure somewhat parallel to the shackle 176, FIGS. 29 and 30, where the shackle exits the housing at wall 182. This inclination may be at an angle determined for a given set of conditions in a given implementation.

What is claimed is:

1. A seal comprising:

a housing made of a first material and having a tapered first chamber with opposing first and second ends, the housing having a first opening in communication with the ambient atmosphere and the chamber at least the chamber first end;

a sleeve in the chamber having a tapered bore in communication with the opening and made of a second material different than the first material, the bore tapering in a first direction from a large transverse dimension adjacent to the chamber second end to a relatively smaller transverse dimension adjacent to the first chamber first end;

a shackle having a free end for insertion into the sleeve tapered bore through the first opening in an insertion direction opposite the first direction; and a locking member being free to displace with the shackle in the first chamber and tapered bore and being arranged to wedge against and between the sleeve and shackle in the tapered sleeve bore when the shackle is displaced in the first direction, for receiving and for gripping the shackle.

2. The seal of claim 1 wherein the second material is stronger than the first material.

3. The seal of claim 1 wherein the second material is harder than the first material.

4. The seal of claim 1 wherein the sleeve is dimensioned to be fixed in place in the housing first chamber.

5. The seal of claim 1 wherein the sleeve is made of steel.

6. The seal of claim 5 wherein the sleeve has a length dimension and has a slit along the length dimension so that the sleeve is radially resilient.

7. The seal of claim 1 wherein the housing first chamber is tapered, the sleeve having an external surface that is complementary to the housing first chamber taper.

8. The seal of claim 1 wherein the locking member is serpentine.

9. The seal of claim 8 wherein the sleeve bore defines an axis, the locking member comprising a plurality of interconnected U-shaped loop members extending along the axis.

10. The seal of claim 1 wherein the housing is at least one of plastic and zinc, the locking member and the sleeve are steel.

11. The seal of claim 1 wherein the sleeve has a length between said chamber ends smaller than the chamber length between the chamber ends, the chamber having a transverse dimension relative to the sleeve outer dimension so that the sleeve can displace in the chamber with the locking member and shackle wedged to each other in response to displacement of the secured shackle in a direction opposite the first direction.

12. The seal of claim 11 wherein the sleeve has an outer peripheral surface, and wherein the sleeve tends to displace in the chamber in response to insertion of the shackle therein, further including means for securing the sleeve in the chamber in fixed position to restrain the displacement of the sleeve in response to said insertion.

13. The seal of claim 12 wherein the means for securing the sleeve includes staking means for staking the sleeve to the housing.

14. The seal of claim 1 having a second chamber for receiving the shackle portion locked to the housing including means for locking the shackle portion to the housing in the second chamber and having a third chamber between the first chamber and second chamber to minimize material in said housing.

15. The seal of claim 1 wherein the sleeve outer peripheral surface and the housing chamber have complementary tapers for receiving the sleeve in the first chamber, the sleeve having a tapered bore.

16. The seal of claim 1 wherein the sleeve, locking member and first chamber are dimensioned so that the sleeve axially displaces in the chamber in response to displacement of the shackle in a direction opposite the first direction and the sleeve and first chamber are dimensioned so that the sleeve catches in the first chamber to provide a resistance to displacement of the shackle in a direction opposite the first direction after the shackle is displaced in the first direction.

17. The seal of claim 1 wherein the sleeve has a tapered bore and complementary tapered external surface terminating at a radially outwardly extending flange at an end of the tapered external surface.

18. The seal of claim 1 wherein the sleeve is sheet material and has a tapered bore and complementary tapered external surface terminating at a smaller diameter end of the sleeve, the smaller diameter end including a folded over double thickness portion of sleeve material.

19. The sleeve of claim 18 wherein the sleeve has an axial extent and has a slit therethrough from the bore to the external surface for the axial extent.

20. The seal of claim 1 wherein the first chamber is circular cylindrical and the sleeve has a circular cylindrical external surface mating with the housing chamber and a tapered bore.

21. The seal of claim 1 wherein the first chamber has a first portion of circular cylindrical diameter, a second adjacent portion that tapers from the first portion to a larger diameter, and a third portion adjacent to the second portion of about the same diameter as the larger diameter and is circular cylindrical, the sleeve having a circular cylindrical outer surface and a tapered bore.

22. The seal of claim 1 wherein the shackle has a portion locked to the housing, said free end extending from the locked portion and from the housing in a first plane, said housing opening terminating in a second plane different than the first plane so that the shackle engages the housing opening during said insertion in the second plane.

23. The seal of claim 22 wherein the first plane intersects the housing first chamber and is normal to the insertion direction.

24. The seal of claim 22 wherein the housing has a second chamber, said shackle portion being locked to the housing in the second chamber, said second chamber having an exit plane through which the shackle passes at an exterior surface of the housing, the exit plane intersecting the housing first chamber.

25. The seal of claim 22 wherein the housing has third and fourth ends and a second chamber, said shackle portion being locked to the housing in the second chamber, the second chamber terminating at a housing fifth end medially the first and second ends.

26. The seal of claim 25 wherein the fifth end is inclined relative to the insertion direction.

27. The seal of claim 1 wherein the housing has a second opening in communication with the ambient atmosphere and with the first chamber at the chamber second end; said sleeve mating with first chamber with a complementary configuration, the sleeve tapered bore in communication with the second opening and comprising harder material than the first material, the locking member for radially resiliently gripping the shackle passing through the locking member bore.

28. A seal comprising:

a housing having first and second ends lying in spaced parallel planes, the housing having a first chamber terminating at the second end at a first opening in communication with the ambient atmosphere and a second chamber terminating at a third housing end at a second opening in communication with the ambient atmosphere, the second opening being medial the spaced parallel planes;

a shackle having a first end secured to the housing in the second chamber and having a free end exiting the second chamber through the second opening, the free end for insertion into the housing first chamber through the first opening in an insertion direction; and a locking member with a bore located in the first chamber, the locking member for receiving and for gripping the shackle passing through the locking member bore, the locking member and chamber being arranged to wedge the locking member in the chamber when the shackle is displaced in a withdrawal direction opposite the insertion direction.

29. The seal of claim 28 including a sleeve captured in the first chamber, the locking member and sleeve being arranged to wedge the locking member against the sleeve in response to displacement of the shackle in the withdrawal direction.

30. The seal of claim 28 wherein the sleeve comprises material that is harder than the housing.

31. The seal of claim 28 wherein the third housing end is inclined relative to the insertion direction.

32. The seal of claim 31 wherein the third housing end is inclined in the range of about 30° to 75°.

33. The seal of claim 28 wherein the third housing end has a surface that defines a plane that intersects the first chamber.

* * * * *